US009327533B2

(12) United States Patent
Wakakusa et al.

(10) Patent No.: US 9,327,533 B2
(45) Date of Patent: May 3, 2016

(54) IMAGE RECORDING APPARATUS

(71) Applicant: BROTHER KOGYO KABUSHIKI KAISHA, Nagoya-shi, Aichi-ken (JP)

(72) Inventors: Keisuke Wakakusa, Nagoya (JP); Yoichiro Nishimura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/864,165

(22) Filed: Sep. 24, 2015

(65) Prior Publication Data

US 2016/0089915 A1 Mar. 31, 2016

(30) Foreign Application Priority Data

Sep. 25, 2014 (JP) ..... 2014-194784

(51) Int. Cl.
*B41J 23/00* (2006.01)
*B41J 25/00* (2006.01)
*B41J 2/145* (2006.01)

(52) U.S. Cl.
CPC ..... *B41J 25/001* (2013.01); *B41J 2/145* (2013.01)

(58) Field of Classification Search
CPC ..... B41J 19/202; B41J 2/1752; B41J 25/34; B41J 19/005; B41J 25/304
USPC ..... 347/37
See application file for complete search history.

(56) References Cited

U.S. PATENT DOCUMENTS

2007/0048058 A1 3/2007 Koga et al.
2007/0048059 A1 3/2007 Asada et al.
2007/0057447 A1 3/2007 Asada et al.
2008/0143786 A1* 6/2008 Oikawa ..... B41J 2/1404 347/47
2008/0157460 A1* 7/2008 Izuchi ..... B64H 3/0669 271/109
2009/0035018 A1 2/2009 Koga et al.
2009/0035019 A1 2/2009 Koga et al.
2013/0257987 A1* 10/2013 Wakakusa ..... B41J 23/14 347/39

FOREIGN PATENT DOCUMENTS

JP 2007-90761 A 4/2007
JP 2009-034832 A 2/2009
JP 2013-208720 A 10/2013

* cited by examiner

*Primary Examiner* — Manish S Shah
*Assistant Examiner* — Yaovi Ameh
(74) *Attorney, Agent, or Firm* — Merchant & Gould P.C.

(57) ABSTRACT

An image recording apparatus, including: a carriage configured to reciprocate in main scanning directions composed of a first direction and a second direction; and a lever member having a lever arm; and a first guide member for guiding the lever arm that protrudes into a movement region of the carriage, wherein the first guide member has an elongate hole through which the lever arm passes and which is defined by first and second edge portions extending in the main scanning directions, the second edge portion located more distant from the carriage than the first edge portion extending outward, in a direction orthogonal to the main scanning directions, from a carriage region over which the carriage passes, the second edge portion having a guide portion inclined such that its downstream end in the second direction is closer to the carriage region than its upstream end in the second direction.

5 Claims, 9 Drawing Sheets

IMAGE RECORDING APPARATUS

CROSS REFERENCE TO RELATED APPLICATION

The present application claims priority from Japanese Patent Application No. 2014-194784, which was filed on Sep. 25, 2014, the disclosure of which is herein incorporated by reference in its entirety.

BACKGROUND OF THE INVENTION

1. Field of the Invention

The present invention relates to an image recording apparatus configured to perform image recording by reciprocating a recording head in main scanning directions together with a carriage, and in particular to such an image recording apparatus in which a power of a drive motor is selectively transmitted to a plurality of drive portions.

2. Description of the Related Art

An ink-jet printer is known as an image recording apparatus configured to record an image on a recording medium by ejecting ink based on input signals.

The ink jetprinter performs image recording by selectively ejecting ink from the recording head to the recording medium during conveyance of the recording sheet from a supply tray to an output tray. The recording sheet is supplied from the supply tray and is conveyed in a conveyance path utilizing rollers such as a supply roller and conveying rollers. Specifically, when the recording sheet is supplied and conveyed, the rollers are rotated while being held in pressing contact with the recording sheet. As a drive source for the rollers, a motor such as a DC motor or a stepping motor is used. A drive power is transmitted from the motor to the rollers by a drive-power transmitting mechanism including pinion gears, a timing belt, and so on.

The recording head of the ink jetprinter may suffer from ejection failure of ink due to air bubbles generated in nozzles from which the ink is ejected and clogging of foreign matters in the nozzles. For prevention of and recovery from the ejection failure of the ink, there is known a technique of removing, by suction, the air bubbles and the foreign matters from the nozzles of the recording head. Such a technique is called purging. A maintenance unit for performing the purging includes a cap for covering the nozzles of the recording head and a pump for reducing a pressure in the cap. The motor is used as a drive source for driving the pump of the maintenance unit and for driving a cam for switching an operating state of an air discharging valve of the maintenance unit. The drive power is transmitted from the motor to the drive portions by the drive-power transmitting mechanism described above.

There have been known image recording apparatus equipped with a switching mechanism for switching the drive portions to which the drive power of the motor as the drive source is to be transmitted. The switching mechanism selectively transmits the drive power to the drive portions depending upon a position of the carriage. Thus, the drive power is transmitted from a single drive source to the conveying rollers when image recording is performed and to the maintenance unit when the purging is performed, for instance.

SUMMARY OF THE INVENTION

In the known switching mechanism, for permitting an input lever to be kept at the most outward position in a movement range of the carriage, it is needed for the carriage to be held in contact with the input lever at that position against a biasing force of a coil spring. In this instance, the carriage receives the biasing force of the coil spring that acts thereon. For enabling a switch gear to slide with high reliability relative to a plurality of transmission gears, the biasing force of the coil spring that biases the switch gear and the input lever is desirably large. If the biasing force of the coil spring is made large, however, the carriage undesirably receives a large load. As a result, it is required to provide a highly rigid mechanism or a large torque of the motor, for holding the carriage. Further, the carriage may receive a force by which the carriage is rotated, so that the posture of the carriage may become unstable.

The present invention provides a technique of increasing a biasing force applied to a lever member for switching drive portions to which a drive power of a motor is to be transmitted, without increasing a load on a carriage.

The present invention provides an image recording apparatus, comprising: a carriage on which a recording head is mounted and which is configured to reciprocate in main scanning directions composed of a first direction and a second direction that are opposite to each other; a first gear configured to rotate about a rotation axis thereof extending along the main scanning directions based on a power of a drive motor; a second gear meshing with the first gear and slidably supported by a support shaft extending along the main scanning directions, the second gear being configured to be slidable to a plurality of slide positions; a plurality of transmission gears parallely disposed at respective positions so as to correspond to the plurality of slide positions of the second gear, each of the transmission gears being configured to mesh with the second gear at a corresponding one of the plurality of slide positions of the second gear; a lever member having a lever arm that protrudes into a movement region of the carriage and supported by the support shaft so as to be slidable and rotatable about the support shaft, the lever member being disposed downstream of the second gear in the first direction of the main scanning directions; a first biasing member configured to elastically bias the second gear toward the first direction; a second biasing member configured to elastically bias the lever member toward the second direction opposite to the first direction by a biasing force larger than that of the first biasing member; and a first guide member configured to guide the lever arm to a plurality of slide positions of the lever member corresponding to the positions of the respective transmission gears, wherein the first guide member has an elongate hole through which the lever arm passes and which extends in the main scanning directions, the elongate hole being defined by a first edge portion and a second edge portion that extend in the main scanning directions, the second edge portion that is located more distant from the carriage than the first edge portion extending outward, in a direction orthogonal to the main scanning directions, from a carriage region over which the carriage passes, the second edge portion having a guide portion that is inclined such that its downstream end in the second direction is closer to the carriage region than its upstream end in the second direction.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Figure 1:
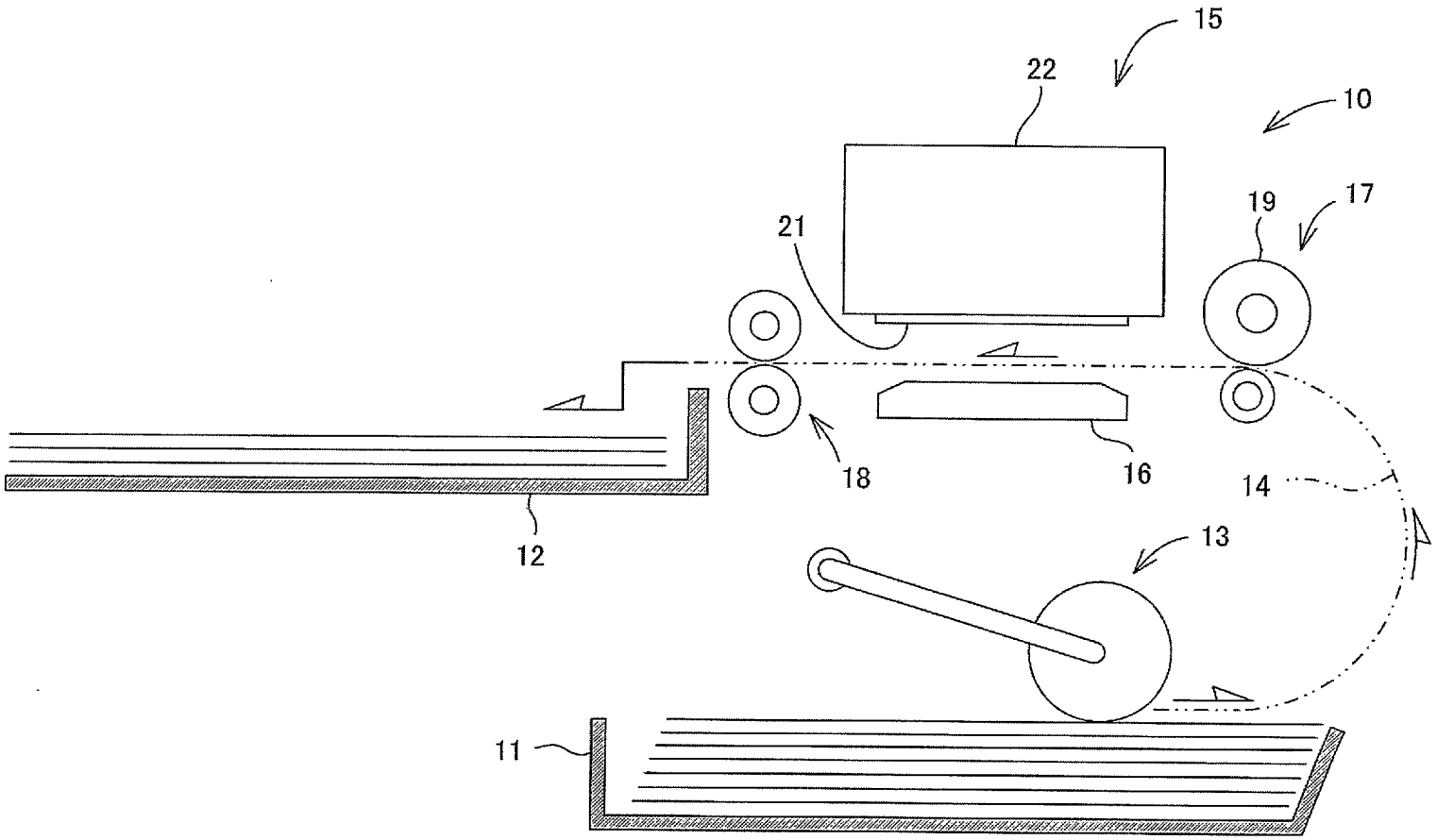
FIG. 1 is a schematic view in cross section schematically showing an internal structure of a printer according to one embodiment of the invention.

There will be hereinafter explained one embodiment of the invention referring to the drawings. It is to be understood that the following embodiment is described only by way of example, and the invention may be otherwise embodied with various modifications without departing from the scope of the invention defined in the attached claims.

General Structure of Printer 10

As shown in FIG. 1, a printer 10 (an one example of an image recording apparatus) is mainly connected to an external information device such as a computer and records images and characters on a recording medium based on print data including image data and document data transmitted from the external information device. Various sorts of storage media such as memory cards may be loaded on the printer 10, and the printer 10 is capable of recording images on the recording medium based on image data stored in the storage media. The recording medium used in the printer 10 includes paper sheets and resin sheets, for instance.

The printer 10 has a supply tray 11 and an output tray 12 arranged in the vertical direction. The supply tray 11 is disposed under the output tray 12 and stores recording sheets, each as a recording medium, in various standard sizes such as an A4 size, a B5 size and a postcard size which are smaller than a legal size, for instance. Each of the recording sheets stored in the supply tray 11 is supplied to a conveyance path 14 by a supply roller 13, a desired image is subsequently recorded thereon by a recording unit 15, and the recording sheet on which the image has been recorded is finally output to the output tray 12.

The conveyance path 14 extends upward from an end portion (a right end portion in FIG. 1) of the supply tray 11, then curves toward a front side of the printer 10, and finally reaches the output tray 12 via the recording unit 15. Thus, each of the recording sheets stored in the supply tray 11 is guided by the conveyance path 14 so as to be conveyed upward while making a U turn and reaches the recording unit 15. After the recording unit 15 records an image on the recording sheet, the recording sheet is output to the output tray 12.

The recording unit 15 is disposed downstream of a curved portion of the conveyance path 14 in a sheet conveyance direction in which the recording sheet is conveyed. The recording unit 15 includes a carriage 22 on which a recording head 21 is mounted and which is configured to reciprocate. To the recording head 21, cyan ink (C), magenta ink (M), yellow ink (Y), and black ink (Bk) are supplied via respective ink tubes 20 (FIG. 2) from respective ink cartridges disposed in the printer 10 independently of the recording head 21. During the reciprocating movement of the carriage 22, the recording head 21 selectively ejects ink of the different colors as minute droplets, so that an image is recorded on the recording sheet conveyed on the platen 16. It is noted that a detailed structure of the recording unit 15 will be later explained.

A conveying roller pair 17 is disposed upstream of the recording unit 15 while a conveying roller pair 18 is disposed downstream of the recording unit 15. The conveying roller pairs 17, 18 nip and convey the recording sheet conveyed through the conveyance path 14. One of two rollers in each conveying roller pair 17, 18 is configured to be rotated by a power of a motor (not shown) transmitted to the one roller while the other of the two rollers in each conveying roller pair 17, 18 is configured to be rotated following the one roller to which the power of the motor is transmitted.

Recording Unit 15

Figure 2:
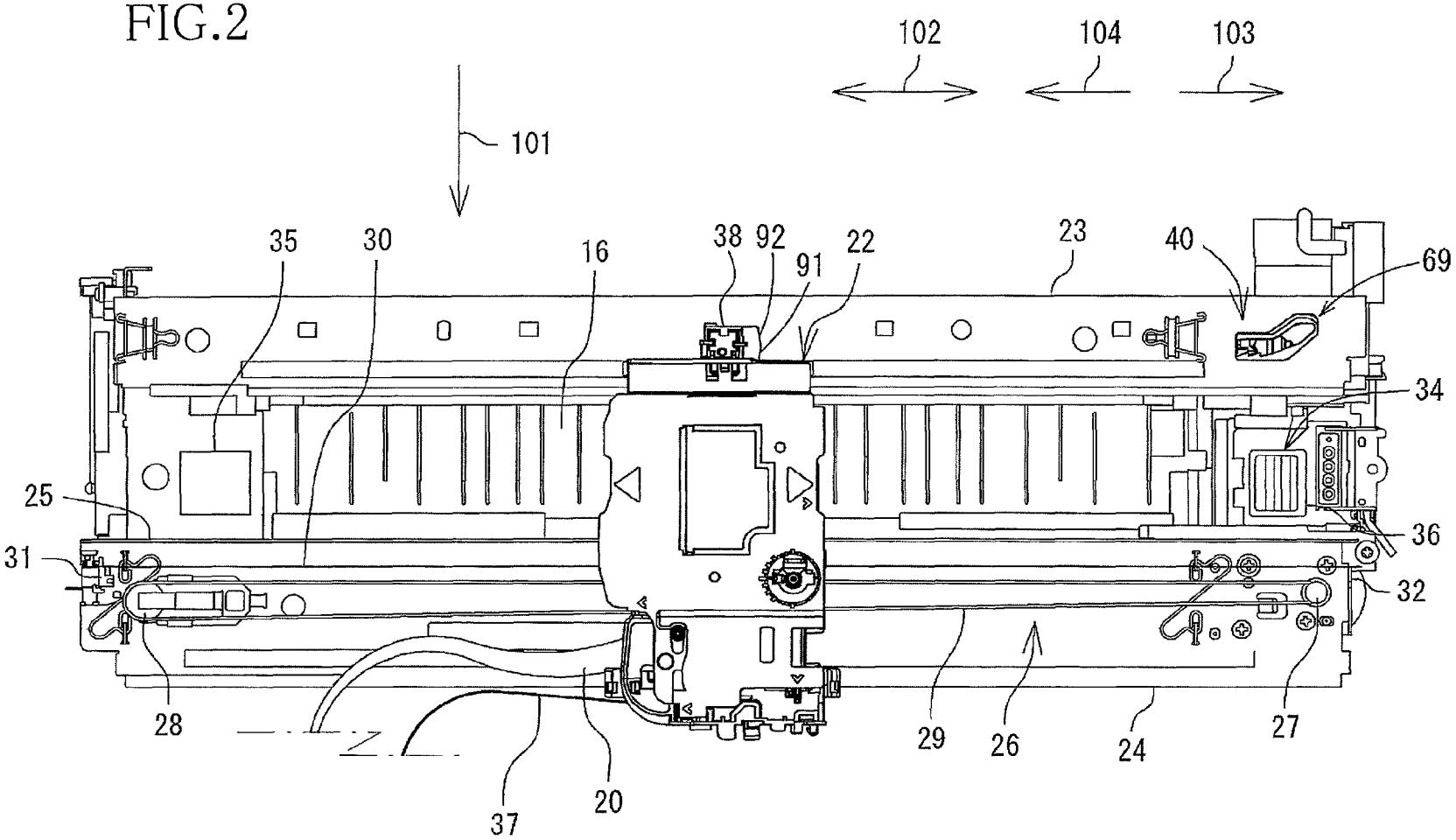
FIG. 2 is a plan view showing a structure of a recording unit of the printer.

As shown in FIG. 2, a pair of guide rails 23, 24 are disposed above the conveyance path 14 so as to be spaced apart from each other by a predetermined distance in a sheet conveyance direction 101 (i.e., a direction from an upper side toward a lower side in FIG. 2). The guide rails 23, 24 extend in main scanning directions 102 (i.e., right and left directions in FIG. 2) orthogonal to the sheet conveyance direction 101. The guide rails 23, 24 are disposed in a housing of the printer 10 and partly constitute a frame for supporting components of the printer 10. The carriage 22 bridges the guide rails 23, 24 so as to slidable on the guide rails 23, 24 in the main scanning directions 102.

The upstream guide rail 23 disposed upstream of the guide rail 24 in the sheet conveyance direction 101 is a long flat plate having a dimension in a widthwise direction of the conveyance path 14 (i.e., the right and left direction in FIG. 2) larger than a range within which the carriage 22 reciprocates. The downstream guide rail 24 disposed downstream of the guide rail 23 in the sheet conveyance direction 101 is a long flat plate having a dimension in the widthwise direction of the conveyance path 14 substantially equal to the corresponding dimension of the guide rail 23. The carriage 22 is slidable in a longitudinal direction of the guide rails 23, 24 in a state in which an upstream end portion of the carriage 22 in the conveyance direction 101 is placed on the guide rail 23 while a downstream end portion of the carriage 22 in the conveyance direction 101 is placed on the guide rail 24. An upstream edge portion 25 of the guide rail 24 in the conveyance direction 101 is bent upward at substantially right angle. The carriage 22 held on the guide rails 23, 24 slidably nips the edge portion 25 by a nipping member such as a roller pair. Thus, the carriage 22 is positioned with respect to the sheet conveyance direction 101 and is slidable in the main scanning directions 102.

A belt driving mechanism 26 is disposed on an upper surface of the guide rail 24. The belt driving mechanism 26 includes a drive pulley 27 and a driven pulley 28, and an annular endless belt 29 having teeth on its inner side. The drive pulley 27 and the driven pulley 28 are disposed near respective widthwise opposite ends of the conveyance path 14, and the belt 29 is tensioned between the two pulleys 27, 28. The drive pulley 27 is rotated by a drive power inputted to its shaft from the motor (not shown), whereby the belt 29 is rotated. The belt 29 is not limited to the annular endless belt, but may be a non-endless belt whose opposite ends are fixed to the carriage 22.

The carriage 22 is fixed at its bottom surface to the belt 29. Thus, the carriage 22 reciprocates on the guide rails 23, 24 along the edge portion 25 in the main scanning directions 102 based on the rotation of the belt 29 by the motor. The recording head 21 is mounted on the carriage 22 and reciprocates in the main scanning directions 102.

An encoder strip 30 of a linear encoder is disposed on the guide rail 24. The encoder strip 30 is shaped like a band and is formed of transparent resin. A pair of support portions 31, 32 are respectively formed at widthwise opposite ends of the guide rail 24 (i.e., opposite ends of the guide rail 24 in the main scanning directions 102) such that the support portions 31, 32 extend upright from the upper surface of the guide rail 24. Opposite ends of the encoder strip 30 are engaged with the respective support portions 31, 32, so that the encoder strip 30 extends along the edge portion 25.

The encoder strip 30 includes light transmitting portions that transmit light and light intercepting portions that intercept light. The light transmitting portions and the light intercepting portions are alternately arranged in a longitudinal direction of the encoder strip 30 at an equal pitch, so as to form a predetermined pattern. An optical sensor of a light transmitting type (not shown) is disposed on the upper surface of the carriage 22 at a position thereof corresponding to the encoder strip 30. The optical sensor reciprocates together with the carriage 22 in the longitudinal direction of the encoder strip 30. During the reciprocating movement, the optical sensor detects the pattern of the encoder strip 30. The recording head 21 includes a head control board for controlling ejection of ink. The head control board outputs pulse signals based on detection signals of the optical sensor. On the basis of the pulse signals, the position of the carriage 22 is determined, and the rotational driving of the motor is controlled. The head control board mounted on the carriage 22 is covered with a cover and is not shown in FIG. 2.

As shown in FIGS. 1 and 2, the platen 16 is disposed below the conveyance path 14 so as to be opposed to the recording head 21. The platen 16 extends over a central portion of the reciprocation range of the carriage 22 on which the recording sheet passes. The platen 16 has a width larger than a width of a maximum-width recording sheet that can be conveyed. Thus, widthwise opposite ends of the recording sheet conveyed through the conveyance path 14 always pass over the platen 16.

As shown in FIG. 2, a purge mechanism 34 is disposed at one of opposite end portions of the platen 16 in its width direction while a waste ink tray 35 is disposed at the other of the opposite end portions of the platen 16 in its width direction. The purge mechanism 34 is for removing, by suction, air bubbles and foreign matters from nozzles of the recording head 21. The purge mechanism 34 includes a cap 36 for covering the nozzles of the recording head 21. The cap 36 is raised and lowered by a known lift-up mechanism so as to move toward and away from the recording head 21. While not shown in FIG. 2, the purge mechanism 34 further includes a suction pump. The suction pump is connected to the cap 36. When the suction pump is activated, the pressure in the cap 36 is reduced to a negative pressure. Thus, when the cap 36 is activated in a state in which the cap 36 contacts the recording head 21 and covers the nozzles and an air discharge opening, the air bubbles and the foreign matters are removed by suction from the recording head 21.

The waste ink tray 35 is for receiving the ink discharged from the recording head 21 in the so-called flushing. Felt as an ink absorber is accommodated in the waste ink tray 35, and the ink discharged in the flushing is absorbed and retained by the felt. Maintenance such as prevention of drying in the recording head 21 and removal of the air bubbles and mixed ink from the recording head 21 is performed using the purge mechanism 34 and the waste ink tray 35.

While not shown in the drawings, the printer 10 has a cartridge mount portion on which are mounted ink cartridges storing ink of different colors. The ink tubes 20 corresponding to the ink of different colors are routed from the cartridge mount portion to the carriage 22. The ink of different colors is supplied from the respective ink cartridges mounted on the cartridge mount portion to the recording head 21 mounted on the carriage 22 via the respective ink tubes 20. The ink tubes 20 are formed of synthetic resin and have flexibility that permits the ink tubes 20 to be flexed following the reciprocation of the carriage 22.

Recording signals and the like are transmitted to the head control board of the recording head 21 from a main board that constitutes a controller (not shown) via a flat cable 37. The main board is disposed on the front portion of the printer 10 (i.e., the lower portion in FIG. 2) and is not illustrated in FIG. 2. The flat cable 37 is a thin belt-like member including conductors which transmit electric signals and which are covered by a synthetic resin film such as a polyester film, so as to be insulated. The main board and the head control board are electrically connected by the flat cable 37. The flat cable 37 has flexibility that permits the flat cable 37 to be flexed following the reciprocation of the carriage 22.

Drive Switching Mechanism 40

There will be next explained a drive switching mechanism 40 configured to selectively transmit the drive power of the motor to the supply roller 13, the purge mechanism 34, and other drive portions. The drive switching mechanism 40 is disposed on a right portion (in FIG. 2) of the frame constituted by the guide rails 23, 24, and so on. The drive switching mechanism 40 selectively transmits the drive power of the motor to the drive portions.

Figure 4:
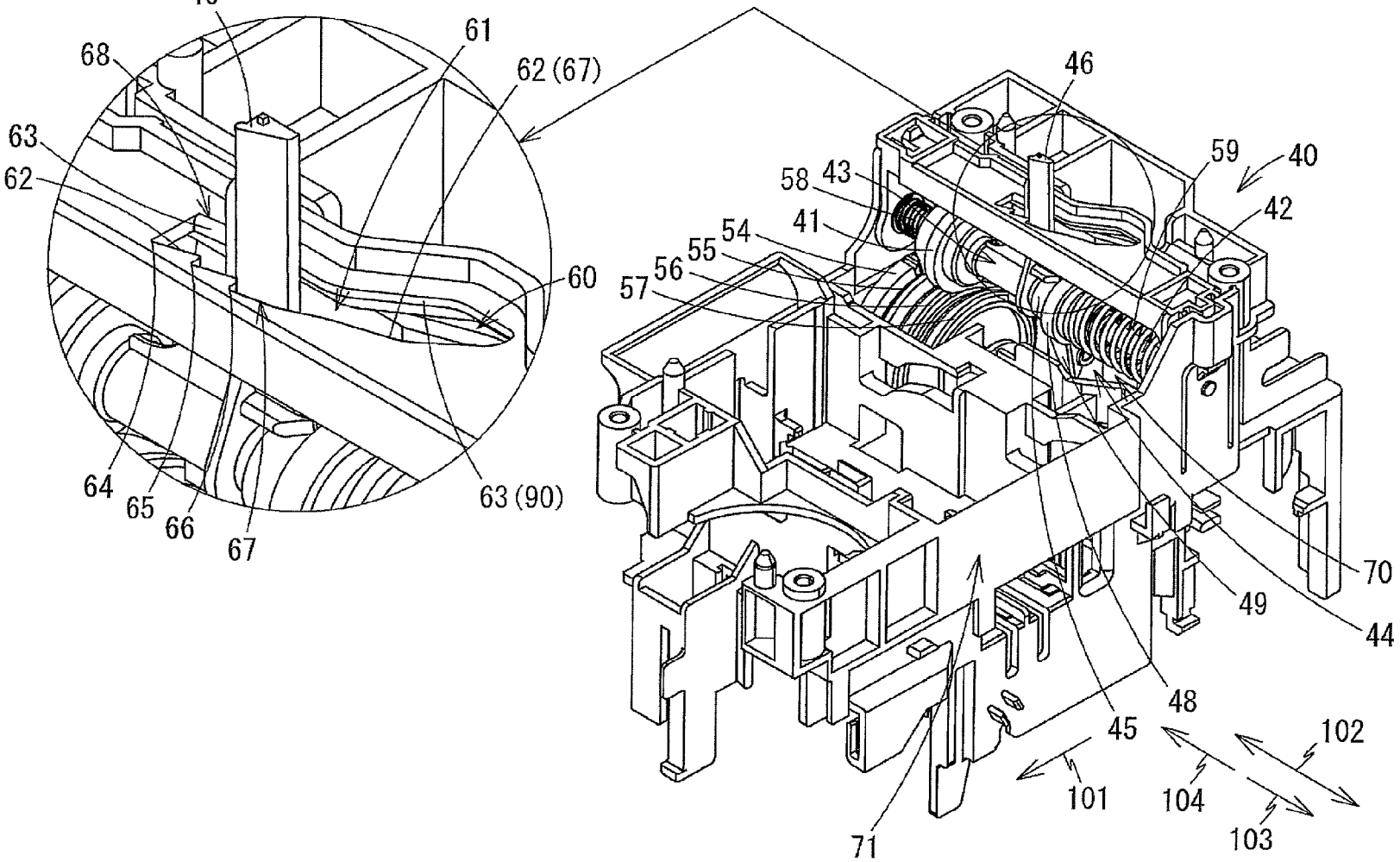
FIG. 4 is a perspective view showing a structure of a drive switching mechanism.

While the motor is not illustrated in the drawings, the drive power of the motor is input to one end (on the left side in FIG. 2) of a drive roller 19 of the conveying roller pair 17. A drive gear (as one example of a first gear), not shown, is provided on the other end (on the right side in FIG. 2) of the drive roller 19 of the conveying roller pair 17, so as to rotate integrally with the drive roller 19 about the same axis as the drive roller 19. That is, the drive gear rotates about the rotation axis of the drive roller 19. A switch gear 41 (as one example of a second gear) shown in FIG. 4 is in mesh with the drive gear, and the switch gear 41 is driven to be rotated based on the drive power of the motor. The drive gear has a thickness that is sufficiently large with respect to a slide range of the switch gear 41, and the switch gear 41 and the drive gear are always in mesh with each other in the slide range of the switch gear 41. The axis of the switch gear 41 is parallel to the axis of the drive gear, and the axes of the switch gear 41 and the drive gear extend along the main scanning directions 102. The switch gear 41 is movable in a direction parallel to the drive gear.

As shown in FIG. 4, the switch gear 41 is supported by a single support shaft 42 so as to be slidable in the axial direction of the support shaft 42 and rotatable about the axis of the support shaft 42. The axis of the support shaft 42 extends along the main scanning directions 102. A support shaft (not illustrated in FIG. 4) is disposed under the support shaft 42 so as to extend in parallel with the support shaft 42. This support shaft rotatably supports transmission gears 54, 55, 56, 57. The transmission gears 54, 55, 56, 57 are arranged in order on the support shaft. The transmission gears 54, 55, 56, 57 are rotatable independently of each other. The switch gear 41 slides on the support shaft 42, whereby the switch gear 41 meshes with a selected one of the transmission gears 54, 55, 56, 57.

In the present embodiment, the transmission gear 54 transmits the drive power of the motor to the supply roller 13. The transmission gear 55 transmits the drive power of the motor to a lower supply roller for supplying the recording sheet from a lower tray disposed below the supply tray 11. The transmission gear 56 transmits the drive power of the motor to a re-conveying roller disposed in a re-conveyance path for duplex recording, specifically, for first inverting the recording sheet having one surface on which an image has been recorded and for subsequently returning the recording sheet in question again to the recording unit 15. The transmission gear 57 transmits the drive power of the motor to the purge mechanism 34. Thus, the drive power of the motor is transmitted to the drive portions via the respective transmission gears 54, 55, 56, 57. It is noted that the drive portions are not limited to those in the present embodiment. It is further noted that the four transmission gears 54, 55, 56, 57 are not necessarily provided in the drive switching mechanism 40. In an instance where the printer 10 does not include the lower tray and the re-conveyance path, spacers may be provided in place of the transmission gears 55, 56 in order to locate the transmission gears 54, 57 at respective predetermined positions.

As shown in FIG. 4, a lever member 43 and a bias switching member 44 are slidably provided on the support shaft 42 so as to be located outward of the switch gear 41 in the reciprocating direction of the carriage 22, namely, so as to be located on the right side of the switch gear 41 in FIG. 3.

Figure 5:
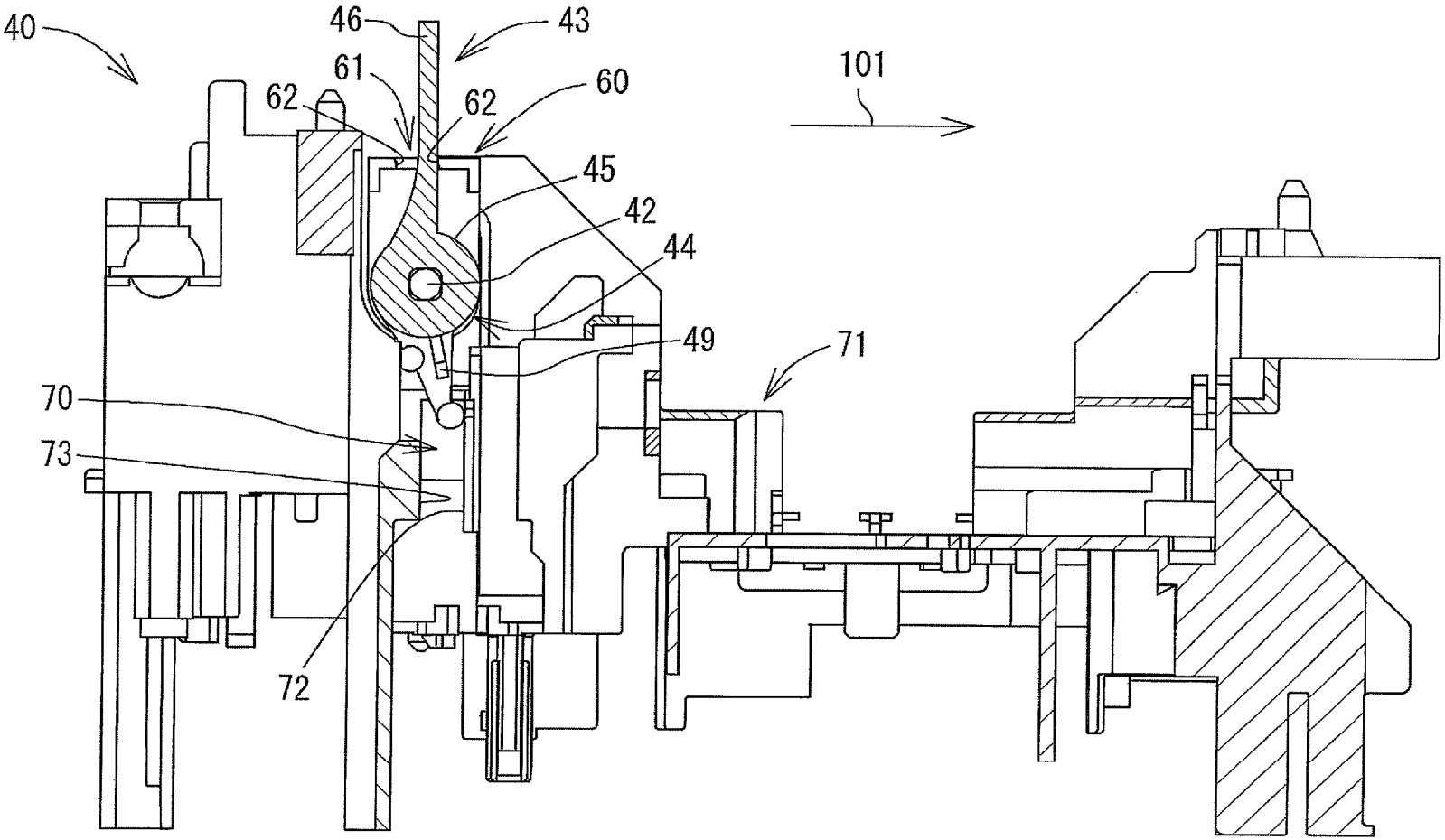
FIG. 5 is a cross-sectional view of the drive switching mechanism 40 cut at a lever member.

As shown in FIGS. 3-5, the lever member 43 includes a cylindrical shaft 45 fitted on the support shaft 42 and a lever arm 46 protruding from the cylindrical shaft 45 in the radial direction thereof. The cylindrical shaft 45 is fitted on the support shaft 42 so as to be rotatable and slidable in the axial direction thereof. That is, the lever arm 46 is slidable in the axial direction of the support shaft 42 and is rotatable about the support shaft 42. The cylindrical shaft 45 extends along the axis of the support shaft 42. One axial end of the cylindrical shaft 45 is in contact with the switch gear 41 while the other axial end thereof is in contact with the bias switching member 44. As shown in FIG. 6, a rib 47 (as one example of a contact portion) is provided on the other axial end of the cylindrical shaft 45 that is in contact with the bias switching member 44. The rib 47 extends from an outer circumferential edge of the other axial end of the cylindrical shaft 45 in the axial direction of the cylindrical shaft 45.

As shown in FIGS. 4 and 5, the bias switching member 44 includes a cylindrical shaft 48 fitted on the support shaft 42 and a switch arm 49 protruding from the cylindrical shaft 48 in the radial direction thereof. The cylindrical shaft 48 is fitted on the support shaft 42 so as to be rotatable and slidable in the axial direction thereof. That is, the switch arm 49 is slidable in the axial direction of the support shaft 42 and rotatable about the support shaft 42. The cylindrical shaft 48 extends along the axis of the support shaft 42. One axial end of the cylindrical shaft 48 is in contact with the lever member 43. As shown in FIG. 6, a cutout 50 that is recessed in the axial direction of the support shaft 42 is formed on an outer circumferential edge of the one axial end of the cylindrical shaft 48 that is in contact with the lever member 43.

As shown in FIG. 6, the cutout 50 of the bias switching member 44 has a bottom end having a convex shape protruding toward the lever member 43 and defined by a first inclined portion 51 and a second inclined portion 52. Each of the first inclined portion 51 and the second inclined portion 52 is a plane extending in the radial direction of the support shaft 42. The first inclined portion 51 and the second inclined portion 52 are continuous to each other in the circumferential direction of the support shaft 42. The rib 47 of the lever member 43 extends into the cutout 50. The distal end of the rib 47 is configured to come into contact selectively with one of the first inclined portion 51 and the second inclined portion 52.

As shown in FIG. 4, the switch gear 41 is elastically biased toward the lever member 43 by a coil spring 58 (as one example of a first biasing member) fitted on the support shaft 42 and configured to extend and contract in the axial direction of the support shaft 42. The bias switching member 44 is elastically biased toward the lever member 43 by a coil spring 59 (as one example of a second biasing member) fitted on the support shaft 42 and configured to extend and contract in the axial direction of the support shaft 42. In the following explanation, the direction in which the switch gear 41 is biased is referred to as a first direction 103 while the direction in which the bias switching member 44 is biased is referred to as a second direction 104. In this respect, it may be expressed that the bias switching member 44 located on the right side (in FIG. 4) of the switch gear 41 is located on a first-direction (103) side while the switch gear 41 located on the left side (in FIG. 4) of the bias switching member 44 is located on a second-direction (102) side. Further, it may be expressed that the bias switching member 44 is located downstream of the switch gear 41 in the first direction 103 and is located upstream of the switch gear 41 in the second direction 104. Similarly, it may be expressed that the switch gear 41 is located upstream of the bias switching member 44 in the first direction 103 and is located downstream of the switch gear 41 in the second direction. These expressions may be applicable to positional relationships of components other than the switch gear 41 and the bias switching member 44.

In the arrangement described above, the switch gear 41 and the bias switching member 44 are biased toward the lever member 43 by the respective coil springs 58, 59 which respectively apply the biasing forces in mutually opposite directions. That is, the coil spring 58 elastically biases the lever member 43 via the switch gear 41 while the coil spring 59 elastically biases the lever member 43 via the bias switching member 44. Thus, the switch gear 41, the lever member 43, and the bias switching member 44 are integrally held in contact with one another on the support shaft 42. The biasing force of the coil spring 59 for biasing the bias switching member 44 (in the second direction 104) is larger than the biasing force of the coil spring 58 for biasing the switch gear 41 (in the first direction 103). Thus, the switch gear 41, the lever member 43, and the bias switching member 44 slide on the support shaft 42 in the second direction 104 as long as no external force is applied.

As shown in FIGS. 2-5, a lever guide 60 (as one example of a first guide member) is disposed above the support shaft 42. The lever guide 60 is fitted in a hole formed at a portion of the guide rail 23 near the purge mechanism 34, so as to be fixed to the guide rail 23. The lever guide 60 is a generally flat plate in which is formed an elongate hole 61 that is long in the main scanning directions 102. The lever arm 46 of the lever member 43 is inserted into and passes through the elongate hole 61. The lever arm 46 that passes through the elongate hole 61 protrudes upward from the guide rail 23 via a hole 69 (shown in FIGS. 2 and 3) formed at a portion of the guide rail 23 located above the elongate hole 61 so as to correspond to the elongate hole 61. As later explained, the bias switching member 44 keeps a rotational posture within a predetermined range with respect to the support shaft 42 by the switch arm 49. Depending upon the relative positional relationship between the lever member 43 and the bias switching member 44, the rib 47 of the lever member 43 comes into contact with one of the first inclined portion 51 and the second inclined portion 52 of the cutout 50 of the bias switching member 44.

The first inclined portion 51 is inclined such that one end of the first inclined portion 51 remote from the second inclined portion 52 is more distant from the lever member 43 in the axial direction of the support shaft 42 than another end of the first inclined portion 51 near the second inclined portion 52. The second inclined portion 52 is inclined such that one end of the second inclined portion 52 remote from the first inclined portion 51 is more distant from the lever member 43 in the axial direction of the support shaft 42 than another end of the second inclined portion 52 near the first inclined portion 51.

When the rib 47 comes into contact with the first inclined portion 51, the lever arm 46 is biased so as to be rotated with respect to the bias switching member 44 toward a first edge portion 62 of the elongate hole 61. When the rib 47 comes into contact with the second inclined portion 52, on the other hand, the lever arm 46 is biased so as to be rotated with respect to the bias switching member 44 toward a second edge portion 63 of the elongate hole 61.

A first stopper portion 64 is formed at one end of the first edge portion 62 on the second-direction (104) side, i.e., at a downstream end of the first edge portion 62 in the second direction 104. Further, a second stopper portion 65 and a third stopper portion 66 are formed at the first edge portion 62 so as to be arranged in order toward the first-direction (103) side, namely, toward the downstream side in the first direction 103. The respective positions of the first stopper portion 64, the second stopper portion 65, and the third stopper portion 66 in the main scanning directions 102 respectively correspond to respective locations of the transmission gears 54, 55, 56 with which the switch gear 41 is to mesh. The second stopper portion 65 and the third stopper portion 66 protrude from the first edge portion 62 toward the upstream side in the sheet conveyance direction 101. In other words, the second stopper portion 65 and the third stopper portion 66 protrude from the first edge portion 62 toward the second edge portion 63. The thus protruded second stopper portion 65 and the third stopper portion 66 are capable of retaining the lever arm 46 biased in the second direction 104 against the biasing force of the coil spring 59. A surface of each of the second stopper portion 65 and the third stopper portion 66 near to the first stopper portion 64 is an inclined surface that is inclined such that its downstream end in the first direction 103 protrudes toward the upstream side in the sheet conveyance direction 101 much more than its upstream end in the first direction 103. When the lever arm 46 slides in the first direction 103 while being guided by the inclined surfaces, the lever arm 46 can get over the second stopper portion 65 and the third stopper portion 66.

A third inclined portion 67 is formed at the first edge portion 62 of the elongate hole 61 so as to be located on the first-direction (103) side, i.e., on the right side, of the third stopper portion 66. That is, the third inclined portion 67 is located downstream of the third stopper portion 66 in the first direction 103. The third inclined portion 67 is inclined such that its downstream end in the first direction 103 protrudes toward the upstream side in the sheet conveyance direction 101 much more than its upstream end in the first direction 103. The lever arm 46 that slides in the first direction 103 along the first edge portion 62 is guided toward the second edge portion 63 by the third inclined portion 67. The third inclined portion 67 extends to one end of the first edge portion 62 on the first-direction (103) side, namely, to a downstream end of the first edge portion 62 in the first direction 103.

A guide portion 90 is formed at a position of the second edge portion 63 of the elongate hole 61 at which the guide portion 90 is opposed to the third inclined portion 67. In other words, the guide portion 90 is formed at one end of the second edge portion 63 on the first-direction (103) side, namely, at a downstream end of the second edge portion 63 in the first direction 103. The guide portion 90 is an inclined surface that is inclined such that one end portion thereof on the second-direction side (104) (the left-side end portion) protrudes toward the downstream side in the sheet conveyance direction 101 much more than one end portion thereof on the first-direction (103) side (the right-side end portion).

The one end portion of the guide portion 90 on the first-direction (103) side extends outward from a carriage region over which the carriage 22 passes. Here, the carriage region includes a range in which the carriage 22 is movable in the main scanning directions 102 and a range in which the carriage 22 can be present or located in the sheet conveyance direction 101. In FIG. 3, the carriage region in the sheet conveyance direction 101 is indicated as "CR". The one end portion of the guide portion 90 on the first-direction (103) side extends more upstream in the sheet conveyance direction 101 than the carriage region CR. That is, the one end portion of the guide portion 90 on the first-direction (103) side extends outward from the carriage region CR in the sheet conveyance direction 101. In other words, one end of the elongate hole 61 on the first-direction (103) side defined by the guide portion 90 and the third inclined portion 67 extends outward of the carriage region CR.

On the other hand, the one end portion of the guide portion 90 on the second-direction (104) side extends into and located in the carriage region CR.

A fourth inclined portion 68 is formed at a position of the second edge portion 63 of the elongate hole 61 at which the fourth inclined portion 68 is opposed to the first stopper portion 64. In other words, the fourth inclined portion 68 is formed at one end of the second edge portion 63 on the second-direction (104) side, namely, at a downstream end of the second edge portion 63 in the second direction 104. The fourth inclined portion 68 is inclined such that its downstream end in the second direction 104 protrudes toward the downstream side in the sheet conveyance direction 101 much more than its upstream end in the second direction 104. The lever arm 46 that slides in the second direction 104 along the second edge portion 63 is guided toward the first edge portion 62 by the fourth inclined portion 68.

As shown in FIGS. 4 and 5, an arm guide 70 (as one example of a second guide member) is disposed under the support shaft 42. The arm guide 70 partly constitutes a frame 71 that supports the support shaft 42 and the lever guide 60. The arm guide 70 takes the form of a groove that is long in the main scanning directions 102 and is open upward. A distal end portion of the switch arm 49 of the bias switching member 44 extends into the arm guide 70.

The arm guide 70 that is a long groove extending in the main scanning directions 102 is defined by a third edge portion 72 located downstream in the sheet conveyance direction 101 and a fourth edge portion 73 located upstream in the sheet conveyance direction 101. The distal end portion of the switch arm 49 of the bias switching member 44 comes into contact selectively with one of the third edge portion 72 and the fourth edge portion 73, whereby the bias switching member 44 slides in the axial direction of the support shaft 42 while being kept at a rotational position in the circumferential direction of the support shaft 42 within a predetermined range.

As shown in FIGS. 6-9, the inner surface of the third edge portion 72 extends generally in the main scanning directions 102, and a fifth inclined portion 74 is formed at a position of the inner surface of the third edge portion corresponding to the position of the third inclined portion 67 of the lever guide 60. The fifth inclined portion 74 is inclined such that its downstream end in the first direction 103 protrudes toward the upstream side in the sheet conveyance direction 101 much more than its upstream end in the first direction 103. The switch arm 49 moves in the first direction 103 along the fifth inclined portion 74, whereby the bias switching member 44 is rotated about the support shaft 42 such that the rib 47 of the lever member 43 that is in contact with the first inclined portion 51 of the bias switching member 44 is caused to move toward the second inclined portion 52.

As shown in FIGS. 6-9, the inner surface of the fourth edge portion 73 extends generally in the main scanning directions 102, and a sixth inclined portion 75 is formed so as to extend, in the first direction 103, from a position of the inner surface of the fourth edge portion 73 corresponding to at least the first stopper portion 64 of the lever guide 60. The sixth inclined portion 75 is inclined such that its downstream end in the second direction 104 protrudes toward the downstream side in the conveyance direction 101 much more than its upstream end in the second direction 104. The switch arm 49 moves in the second direction 104 along the sixth inclined portion 75, whereby the bias switching member 44 is rotated about the support shaft 42 such that the rib 47 of the lever member 43 that is in contact with the second inclined portion 52 of the bias switching member 44 is caused to move toward the first inclined portion 51.

The inclination angles of the third inclined portion 67 and the fourth inclined portion 68 of the lever guide 60 with respect to the main scanning directions 102 are smaller than the inclination angles of the fifth inclined portion 74 and the sixth inclined portion 75 of the arm guide 70 with respect to the main scanning directions 102. Thus, the rotation amount of the lever member 43 about the support shaft 42 by the third inclined portion 67 or the fourth inclined portion 68 is smaller than the rotation amount of the bias switching member 44 about the support shaft 42 by the fifth inclined portion 74 or the sixth inclined portion 75.

As shown in FIG. 2, a guide piece 38 is provided at an upstream end of the carriage 22 in the sheet conveyance direction 101 so as to protrude toward the upstream side in the sheet conveyance direction 101. The guide piece 38 is reciprocated together with the carriage 22. When the guide piece 38 is moved in the first direction 103 together with the carriage 22, the guide piece 38 comes into contact with the lever arm 46 of the lever member 43, so that the lever arm 46 is moved in the first direction 103.

A first contact surface 91 and a second contact surface 92 (each as one example of a contact surface) are formed at a portion of the guide piece 38 at which the guide piece comes into contact with the lever arm 46.

The first contact surface 91 and the second contact surface 92 are continuous to each other at a position in the sheet conveyance direction 101 that is located nearer to the second edge portion 63 than the protruding ends of the second stopper portion 65 and the third stopper portion 66, namely, at a position that is located more upstream in the sheet conveyance direction 101 than the protruding ends of the second stopper portion 65 and the third stopper portion 66. The first contact surface 91 is located nearer to the first edge portion 62 than a boundary of the first and second contact surfaces 91, 92. The second contact surface 92 is located nearer to the second edge portion 63 than the boundary.

The first contact surface 91 is an inclined surface that is inclined such that its upstream end in the sheet conveyance direction 101 near the boundary protrudes toward the first direction 103 much more than its downstream end in the sheet conveyance direction 101 remote from the boundary. In other words, the first contact surface 91 is inclined with respect to the main scanning directions 102 so as to face the first edge portion 62. The second contact surface 92 is an inclined surface that is inclined such that its downstream end in the sheet conveyance direction 101 near the boundary protrudes toward the first direction 103 much more than its upstream end in the sheet conveyance direction 101 remote from the boundary. In other words, the second contact surface 92 is inclined with respect to the main scanning directions 102 so as to face the second edge portion 63.

Switching of Transmission of Drive Power by Drive Switching Mechanism 40

Hereinafter, there will be explained a manner of switching transmission of the drive power of the motor by the sliding movement of the switch gear 41 for meshing with a selected one of the transmission gears 54, 55, 56, 57.

Figure 3B:
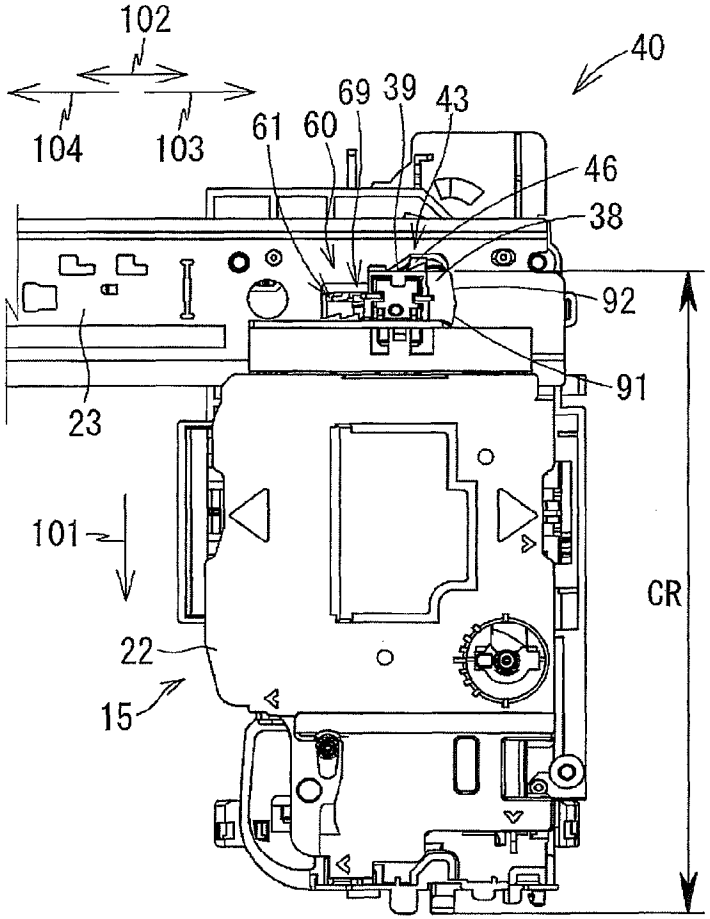
FIGS. 3A and 3B are plan views each showing a portion of the printer in the vicinity of a carriage and a lever guide.
Figure 3A:
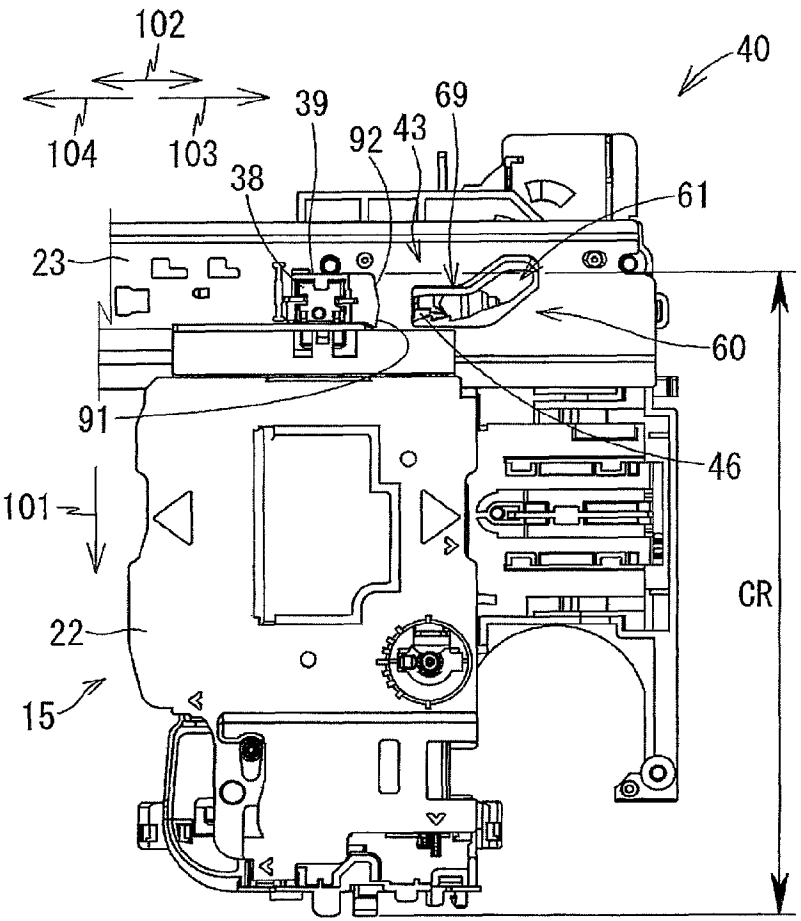
Figures 6A, 6B:
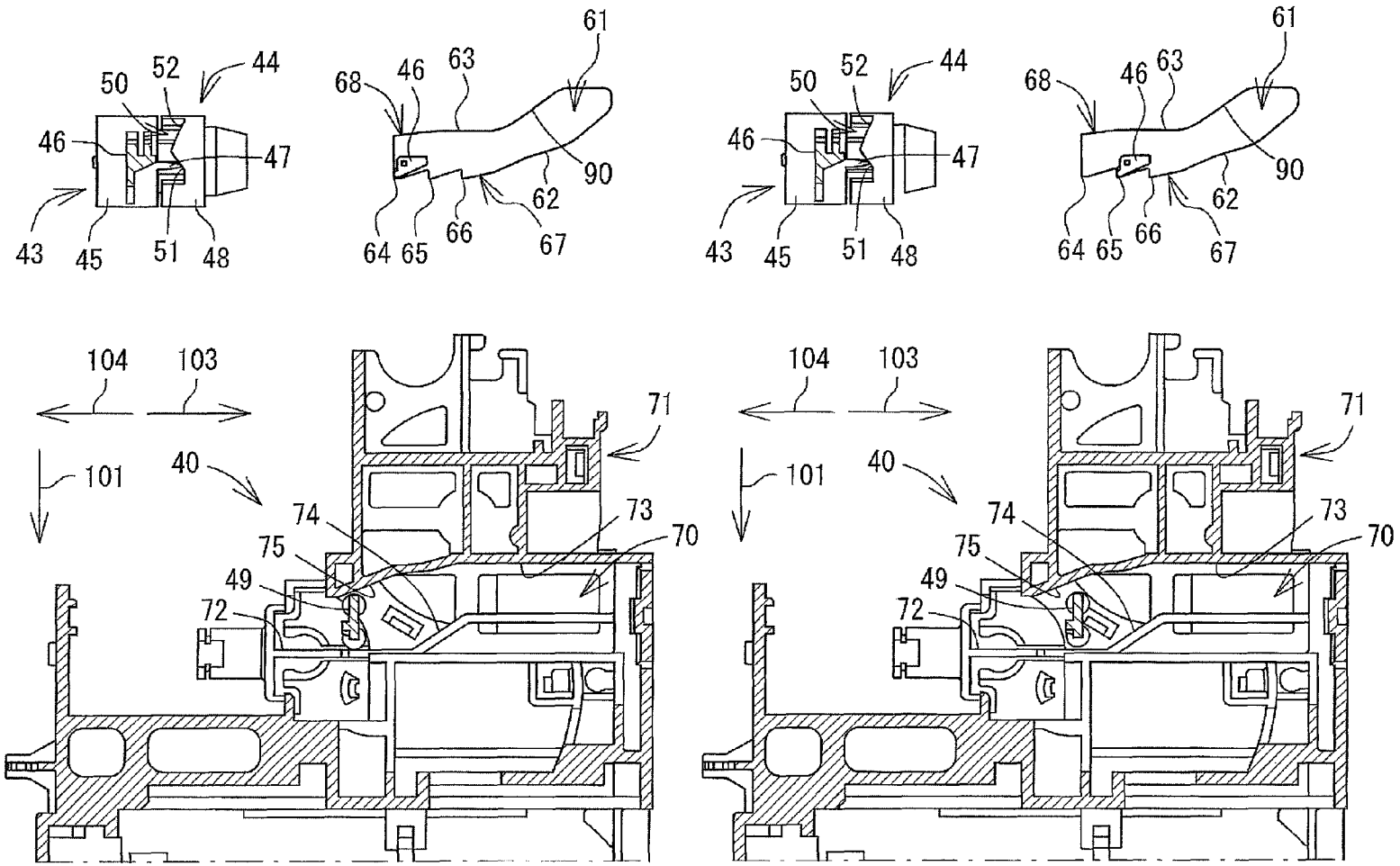
FIGS. 6A and 6B are views showing an operation of the drive switching mechanism.

As shown in FIGS. 3A and 6A, when the lever arm 46 is retained or stopped by the first stopper portion 64 of the lever guide 60, the distal end portion of the switch arm 49 of the bias switching member 44 is in contact with a part of the third edge portion 72 of the arm guide 70 located on the second-direction (104) side of the fifth inclined portion 74, namely, on the downstream side of the fifth inclined portion 74 in the second direction 104. In this state, the rib 47 of the lever member 43 is in contact with the first inclined portion 51 of the bias switching member 44, and the lever member 43 and the bias switching member 44 are biased by the two coil springs 58, 59 so as to be in contact with each other, so that the lever arm 46 of the lever member 43 is biased toward the first edge portion 62 of the lever guide 60. Thus, the lever arm 46 is kept retained by the first stopper portion 64. When the lever member 43 is located at this position, the switch gear 41 is held at the most upstream one of slide positions thereof in the first direction 103 and meshes with the corresponding transmission gear 54. Consequently, the drive power of the motor is transmitted to the supply roller 13, so that the supply roller 13 is rotated so as to supply the recording sheet from the supply tray 11.

When the guide piece 38 of the carriage 22 comes into contact with the lever arm 46 located at the position shown in FIG. 6A and moves in the first direction 103, the lever arm 46 is moved from the first stopper portion 64 to the second stopper portion 65. In this instance, since the lever arm 46 is biased toward the first edge portion 62, the lever arm 46 comes into contact with the first contact surface 91 of the guide piece 38 located near the first edge portion 62. Thus, the lever arm 46 is biased by the two coil springs 58, 59 such that the lever member 43 and the bias switching member 44 are in contact with each other. In addition, the lever arm 46 is biased toward the first edge portion 62 also by the first contact surface 91. As a result, the lever arm 46 is moved from the first stopper portion 64 to the second stopper portion 65 along the first edge portion 62.

When the lever arm 46 is retained or stopped by the second stopper portion 65 as shown in FIG. 6B, the distal end portion of the switch arm 49 of the bias switching member 44 is in contact with a part of the third edge portion 72 of the arm guide 70 located on the second-direction (104) side of the fifth inclined portion 74, namely, on the downstream side of the fifth inclined portion 74 in the second direction 104. In this state, the rib 47 of the lever member 43 is in contact with the first inclined portion 51 of the bias switching member 44, and the lever member 43 and the bias switching member 44 are biased by the two coil springs 58, 59 so as to be in contact with each other, so that the lever arm 46 of the lever member 43 is biased toward the first edge portion 62 of the lever guide 60. Thus, the lever arm 46 is kept retained by the second stopper portion 65. When the lever member 43 is located at this position, the switch gear 41 is held at the second upstream one of the slide positions thereof in the first direction 103 and meshes with the corresponding transmission gear 55. Consequently, the drive power of the motor is transmitted to the lower supply roller, so that the lower supply roller is rotated so as to supply the recording sheet from the lower tray.

When the first contact surface 91 of the guide piece 38 of the carriage 22 comes into contact with the lever arm 46 located at the position shown in FIG. 6B and moves in the first direction 103, the lever arm 46 is moved from the second stopper portion 65 to the third stopper portion 66.

Figure 7B:
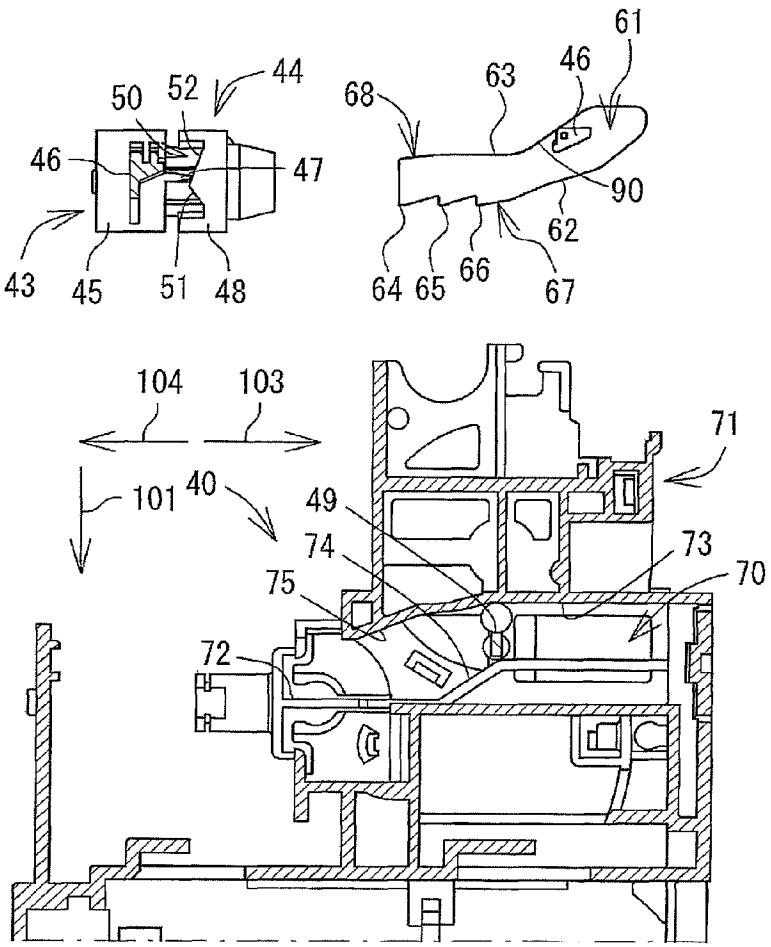
FIGS. 7A and 7B are views showing an operation of the drive switching mechanism.
Figure 7A:
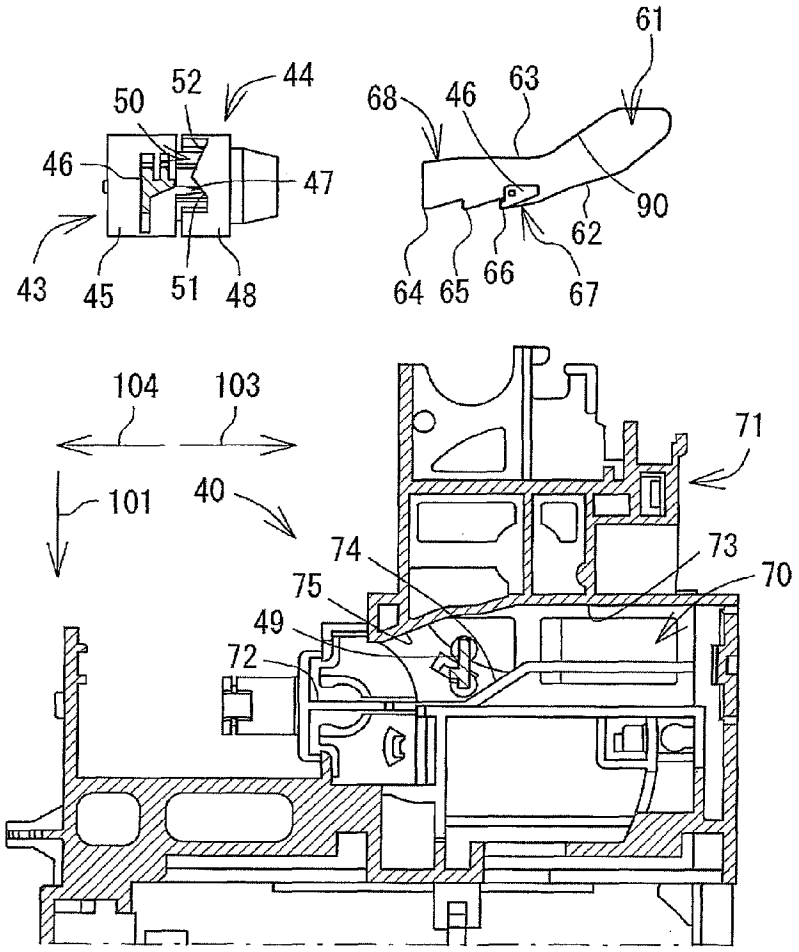

When the lever arm 46 is retained or stopped by the third stopper portion 66 as shown in FIG. 7A, the distal end portion of the switch arm 49 of the bias switching member 44 is in contact with a part of the third edge portion 72 of the arm guide 70 located near one end of the fifth inclined portion 74 on the second-direction (104) side, namely, located near a downstream end of the fifth inclined portion 74 in the second direction 104. In this state, the rib 47 of the lever member 43 is in contact with the first inclined portion 51 of the bias switching member 44, and the lever member 43 and the bias switching member 44 are biased by the two coil springs 58, 59 so as to be in contact with each other, so that the lever arm 46 of the lever member 43 is biased toward the first edge portion 62 of the lever guide 60. Thus, the lever arm 46 is kept retained by the third stopper portion 66. When the lever member 43 is located at this position, the switch gear 41 is held at the third upstream one of the slide positions thereof in the first direction 103 and meshes with the corresponding transmission gear 56. Consequently, the drive power of the motor is transmitted to the re-conveying roller, so that the re-conveying roller is rotated so as to convey the recording sheet in the re-conveyance path.

When the first contact surface 91 of the guide piece 38 of the carriage 22 comes into contact with the lever arm 46 located at the position shown in FIG. 7A and moves in the first direction 103, the lever arm 46 is moved from the third stopper portion 66 further in the first direction 103.

During the movement of the lever arm 46 from the third stopper portion 66 in the first direction 103, the lever arm 46 is moved along the third inclined portion 67 of the lever guide 60. As a result, the lever arm 46 is moved not only in the first direction 103 but also toward the upstream side in the sheet conveyance direction 101, so that the lever arm 46 is moved away from the first contact surface 91 and comes into contact with the second contact surface 92. Further, the distal end portion of the switch arm 49 of the bias switching member 44 moves along the fifth inclined portion 74 of the third edge portion 72 of the arm guide 70. Thus, the lever member 43 and the bias switching member 44 are rotated relative to each other about the support shaft 42 in opposite directions, so that the rib 47 of the lever member 43 is moved from the first inclined portion 51 of the bias switching member 44 toward the second inclined portion 52 thereof. The lever arm 46 of the lever member 43 comes into contact with the second contact surface 92, and the lever member 43 and the bias switching member 44 are biased by the two coil springs 58, 59 so as to be in contact with each other. Consequently, the lever arm 46 is biased toward the second edge portion 63 of the lever guide 60, so that the lever arm 46 comes into contact with the guide portion 90, as shown in FIG. 7B.

When the carriage 22 is moved further in the first direction 103 from the position shown in FIG. 7B, the lever arm 46 biased toward the second edge portion 63 is moved in the first direction 103 along the guide portion 90 that is opposed to the third inclined portion 67, so that the lever arm 46 is moved toward the upstream side in the sheet conveyance direction 101 as well as in the first direction 103. As a result, when the lever arm 46 is located more downstream in the first direction 103 than the guide portion 90, the lever arm 46 is moved away from the second contact surface 92 of the guide piece 38 of the carriage 22 and is located more upstream in the sheet conveyance direction 101 than the carriage 22, as shown in FIGS. 3B and 8A. In other words, the lever arm 46 is located outside the carriage region CR. As a result, the lever arm 46 is no more pushed in the first direction 103 by the carriage 22. In this instance, the lever arm 46 located outside the carriage region CR reaches the downstream end of the elongate hole 61 in the first direction 103. Further, the lever arm 46 located outside the carriage region CR is sandwiched by and between the second edge portion 63 and an upstream surface 39 (FIG. 3B) of the guide piece 38 in the sheet conveyance direction 101. Thus, the lever arm 46 is inhibited from moving in the second direction 104 by the guide piece 38.

In this instance, the biasing forces of the coil springs 58, 59 are applied from the lever arm 46 to the upstream surface 39 of the guide piece 38. The biasing forces are smaller than those of the coil springs 58, 59 applied from the lever arm 46 to the contact surface 91, 92 when the lever arm 46 is in contact with the first contact surface 91 or the second contact surface 92. Further, the position of the carriage 22 at this time is equal to that when the recording head 21 is covered by the cap 36. When the lever member 43 is located at the downstream end of the elongate hole 61 in the first direction 103, the switch gear 41 is held at the most downstream one of the slide positions thereof in the first direction 103 and meshes with the corresponding transmission gear 57. Consequently, the drive power of the motor is transmitted to the purge mechanism 34, so that the purge mechanism 34 is driven for removing the air bubbles and the foreign matters from the nozzles of the recording head 21.

When the switch gear 41 moves from one of the slide positions at which the switch gear 41 meshes with a corresponding one of the transmission gears 54, 55, 56, 57, a surface pressure between the switch gear 41 and a currently meshing one of the transmission gears 54, 55, 56, 57 is released by a control in which the switch gear 41 is slightly rotated in a direction opposite to the direction in which the switch gear 41 has been rotated so far, for instance. Subsequently, slight forward and reverse rotations of the switch gear 41 are alternately repeated for matching phases of the switch gear 41 and a next one of the transmission gears 54, 55, 56, 57 to next mesh with the switch gear 41. Thus, the phases of the switch gear 41 and the next one of the transmission gears 54, 55, 56, 57 match with each other, and the switch gear 41 slides on the support shaft 42 by the biasing force of the coil spring 58 so as to be disengaged from the currently meshing one of the transmission gears 54, 55, 56, 57 and to mesh with the next one of the transmission gears 54, 55, 56, 57.

When the carriage 22 moves in the second direction 104 from the position shown in FIG. 8A, the guide piece 38 moves away from the lever arm 46, whereby the lever arm 46 is biased by the coil springs 58, 59 so as to slide in the second direction 104. Thus, the lever arm 46 slides in the second direction 104 along the guide portion 90.

Figure 8B:
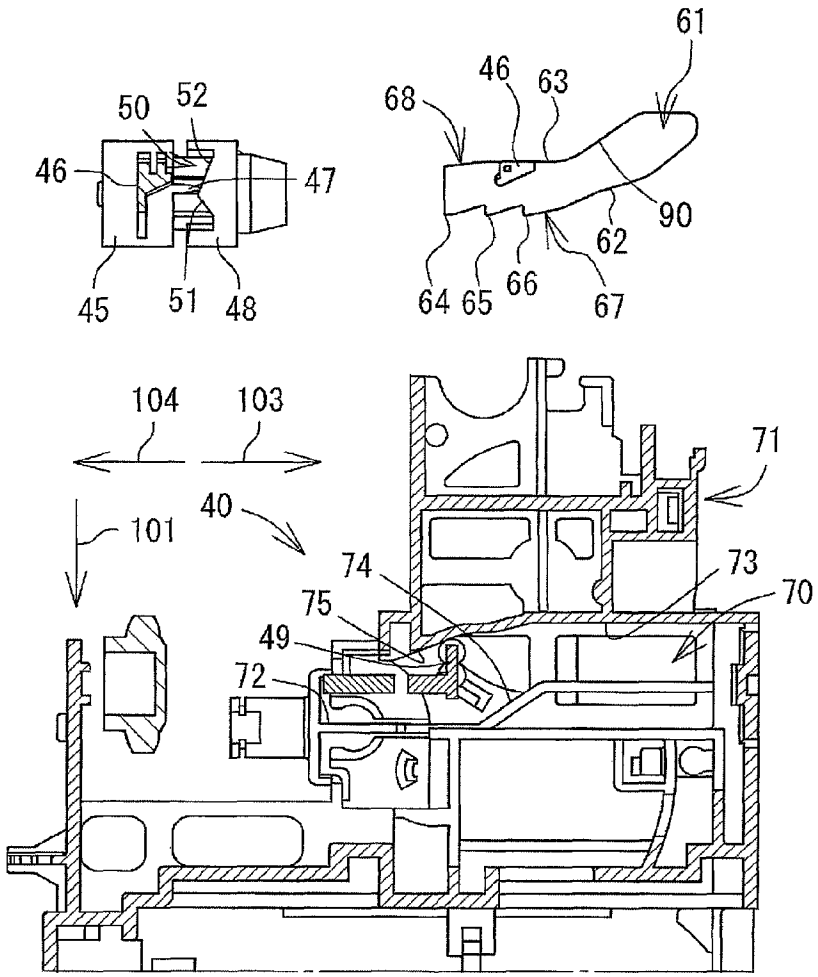
FIGS. 8A and 8B are views showing an operation of the drive switching mechanism.
Figure 8A:
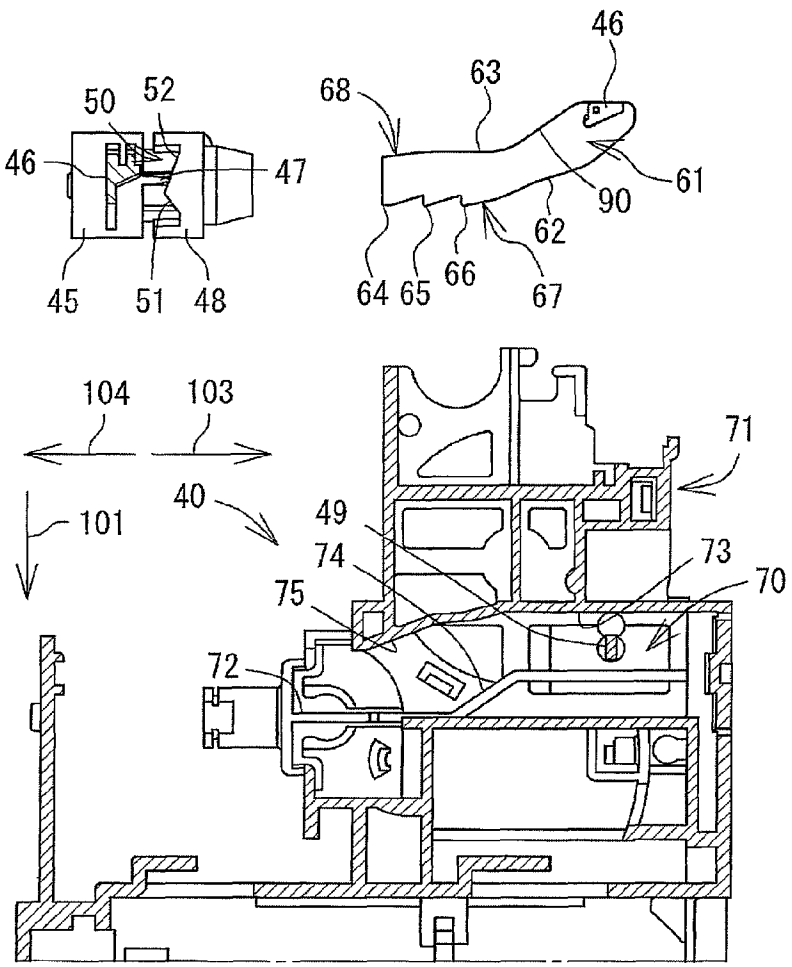
Figure 9:
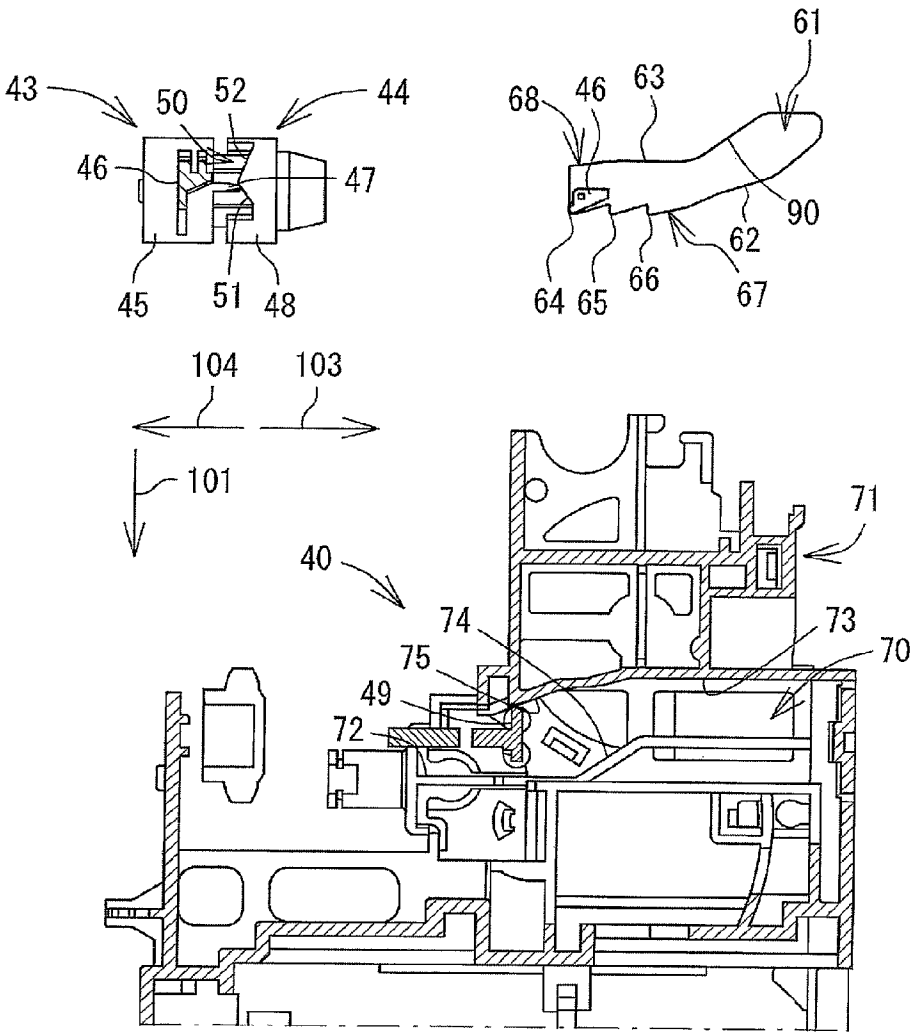
FIG. 9 is a view showing an operation of the drive switching mechanism.

As shown in FIG. 8B, during the movement of the lever arm 46 from the most downstream position in the first direction 103 toward the second direction 104 along the second edge portion 63, the distal end portion of the switch arm 49 of the bias switching member 44 reaches the sixth inclined portion 75 of the fourth edge portion 73 of the arm guide 70 and moves along the sixth inclined portion 75. Further, when the lever arm 46 moves toward the downstream side in the second direction 104, the lever arm 46 moves along the fourth inclined portion 68 of the second edge portion 63. Thus, as shown in FIG. 9, the lever member 43 and the bias switching member 44 are rotated relative to each other about the support shaft 42 in opposite directions, so that the rib 47 of the lever member 43 is moved from the second inclined portion 52 of the bias switching member 44 toward the first inclined portion 51 thereof. The lever member 43 and the bias switching member 44 are biased by the two coil springs 58, 59 so as to be in contact with each other, and the lever arm 46 of the lever member 43 is biased toward the first edge portion 62 of the lever guide 60. Then the lever arm 46 is retained or stopped by the first stopper portion 64 of the lever guide 60 as shown in FIG. 6A.

Advantageous Effects of Embodiment

In the printer 10 of the illustrated embodiment, the recording head 21 selectively ejects ink when the recording head 21 is reciprocated together with the carriage 22, so that an image is recorded on the recording medium. The motor gives the drive power to a plurality of drive portions of the printer 10 configured to perform conveyance of the recording medium, maintenance, and the like. For instance, the rotation of the motor is controlled at different timing. The drive power of the motor is transmitted selectively to the transmission gears 54, 55, 56, 57 via the drive gear and the switch gear 41.

When the carriage 22 comes into contact with the lever arm 46, the lever arm 46 is moved in the first direction 103 against the biasing force of the coil spring 59. The lever arm 46 slides in the elongate hole 61 of the lever guide 60, so that the lever member 43 is positioned at a predetermine position on the support shaft 42 against the biasing force of the coil spring 59. Since the switch gear 41 is biased toward the lever member 43 by the coil spring 58, the switch gear 41 slides on the support shaft 42 following the sliding movement of the lever member 43, so that the switch gear 41 is positioned at a position at which the switch gear 41 is in contact with the lever member 43. The switch gear 41 that slides as described above meshes with a selected one of the transmission gears 54, 55, 56, 57.

The lever arm 46 comes into contact with the carriage 22 that moves in the first direction 103, whereby the lever arm 46 is moved in the elongate hole 61 in the first direction 103. The lever arm 46 that is moved in the first direction 103 by the carriage 22 is moved outside the carriage region CR at the second edge portion 63, so that the lever arm 46 comes into contact with the guide portion 90 of the elongate hole 61 outside the carriage region CR. Thus, the lever arm 46 is inhibited from moving in the second direction 104.

When the lever arm 46 is located at one of its slide positions at which the lever arm 46 is retained by one of the stopper portions 64, 65, 66 of the lever guide 60, the rib 47 of the lever arm 46 is in contact with the first inclined portion 51 of the bias switching member 44, and the lever arm 46 is biased toward the first edge portion 62 of the lever guide 60 by the biasing forces of the coil springs 58 and the coil spring 59. Thus, the lever arm 46 is retained by one of the stopper portions 64, 65, 66 of the first edge portion 62 with high reliability. When the lever arm 46 is moved downstream of the stopper portions 64, 65, 66 in the first direction 103, the lever arm 46 is guided toward the second edge portion 63 by the third inclined portion 67. Consequently, the lever member 43 is rotated relative to the support shaft 42, and the rib 47 of the lever arm 46 comes into contact with the second inclined portion 52 of the bias switching member 44, so that the lever arm 46 is biased toward the second edge portion 63 of the lever guide 60 by the biasing forces of the coil spring 58 and the coil spring 59. When the carriage 22 moves in the second direction 104, the lever arm 46 is moved in the second direction 104 along the second edge portion 63 of the lever guide 60 by the biasing force of the coil spring 59. Thus, during the movement of the lever arm 46 in the second direction 104, the lever arm 46 is not retained or stopped by any of the stopper portions 64, 65, 66. When the lever arm 46 is moved to a position of the second edge portion 63 at which the lever arm 46 is opposed to the first stopper portion 64 that is the most downstream one of the stopper portions 64, 65, 66 in the second direction 104, the lever arm 46 is guided toward the first edge portion 62 by the fourth inclined portion 68. Thus, the rib 47 of the lever arm 46 comes into contact with the first inclined portion 51 of the bias switching member 44, so that the lever arm 46 is biased toward the first edge portion 62 of the lever guide 60 by the biasing forces of the coil spring 58 and the coil spring 59.

The carriage 22 has the first contact surface 91 and the second contact surface 92. When the carriage 22 moves in the first direction 103 with the first contact surface 91 held in contact with the lever arm 46, the lever arm 46 is guided toward the first edge portion 62. When the carriage 22 moves in the first direction 103 with the second contact surface 92 held in contact with the lever arm 46, the lever arm 46 is guided toward the second edge portion 63.

The arm guide 70 has the fifth inclined portion 74 and the sixth inclined portion 75. Consequently, the relative position of the lever member 43 and the bias switching member 44 is changed not only by the lever guide 60 but also by the arm guide 70, so that it is possible to decrease the amount of the sliding movement of the lever member 43 in the main scanning directions 102 that is required in switching of the biasing force of the bias switching member 44.

According to the printer 10 of the illustrated embodiment, it is possible to increase the biasing forces of the coil springs 58, 59 for biasing the lever member 43 while avoiding an increase in the load on the carriage 22.

In the illustrated embodiment, the three stopper portions are provided in the drive switching mechanism 40. The number of positions at which the drive power is transmitted to the respective drive portions is not limited to that in the illustrated embodiment, but may be increased or decreased without departing from the scope of the invention. Only one of the three the stopper portions 64, 65, 66, e.g., only the first stopper portion 64, may be formed. In this instance, when the lever arm 46 is retained by the first stopper portion 64, the switch gear 41 meshes with the transmission gear 54, so that the drive power of the motor is transmitted to the supply roller 13. On the other hand, when the lever arm 46 is located at a position which is outside the carriage region CR and which is the downstream end of the elongate hole 61 in the first direction 103, the switch gear 41 meshes with the transmission gear 57, so that the drive power of the motor is transmitted to the purge mechanism 34.

What is claimed is:

1. An image recording apparatus, comprising:

a carriage on which a recording head is mounted and which is configured to reciprocate in main scanning directions composed of a first direction and a second direction that are opposite to each other;

a first gear configured to rotate about a rotation axis thereof extending along the main scanning directions based on a power of a drive motor;

a second gear meshing with the first gear and slidably supported by a support shaft extending along the main scanning directions, the second gear being configured to be slidable to a plurality of slide positions;

a plurality of transmission gears parallely disposed at respective positions so as to correspond to the plurality of slide positions of the second gear, each of the transmission gears being configured to mesh with the second gear at a corresponding one of the plurality of slide positions of the second gear;

a lever member having a lever arm that protrudes into a movement region of the carriage and supported by the support shaft so as to be slidable and rotatable about the support shaft, the lever member being disposed downstream of the second gear in the first direction of the main scanning directions;

a first biasing member configured to elastically bias the second gear toward the first direction;

a second biasing member configured to elastically bias the lever member toward the second direction opposite to the first direction by a biasing force larger than that of the first biasing member; and a first guide member configured to guide the lever arm to a plurality of slide positions of the lever member corresponding to the positions of the respective transmission gears, wherein the first guide member has an elongate hole through which the lever arm passes and which extends in the main scanning directions, the elongate hole being defined by a first edge portion and a second edge portion that extend in the main scanning directions, the second edge portion that is located more distant from the carriage than the first edge portion extending outward, in a direction orthogonal to the main scanning directions, from a carriage region over which the carriage passes, the second edge portion having a guide portion that is inclined such that its downstream end in the second direction is closer to the carriage region than its upstream end in the second direction.

2. The image recording apparatus according to claim 1, wherein the carriage has a contact surface that comes into contact with the lever arm when the carriage moves in the first direction, the contact surface being inclined with respect to the main scanning directions so as to face toward the second edge portion.

3. The image recording apparatus according to claim 1, further comprising:

a bias switching member slidably supported by the support shaft and having a first inclined portion and a second inclined portion, the bias switching member being disposed downstream of the lever member in the first direction;

a contact portion provided on the lever member and configured to come into contact selectively with one of the first inclined portion and the second inclined portion; and a second guide member configured to permit the bias switching member to be kept at a rotational position in a circumferential direction of the support shaft, wherein the second biasing member elastically biases the lever member via the bias switching member, wherein the first edge portion includes a plurality of stopper portions for retaining the lever arm that is biased in the second direction and a third inclined portion by which the lever arm is rotated toward the second edge portion, the third inclined portion being disposed downstream of the stopper portions in the first direction, wherein the second edge portion includes a fourth inclined portion by which the lever arm is rotated toward the first edge portion, the fourth inclined portion being disposed at a position of the second edge portion at which the fourth inclined portion is opposed to the most downstream one of the stopper portions in the second direction, wherein, when the lever arm is guided toward the second edge portion by the third inclined portion, the contact portion that is in contact with the first inclined portion is caused to come into contact with the second inclined portion, so that the bias switching member switches a biasing state of the lever member such that the lever arm that is biased toward the first edge portion is caused to be biased toward the second edge portion, and wherein, when the lever arm is guided toward the first edge portion by the fourth inclined portion, the contact portion that is in contact with the second inclined portion is caused to come into contact with the first inclined portion, so that the bias switching member switches the biasing state of the lever member such that the lever arm that is biased toward the second edge portion is caused to be biased toward the first edge portion.

4. The image recording apparatus according to claim 3, wherein the stopper portions protrude from the first edge portion toward the second edge portion, wherein the carriage is configured to come into contact with the lever arm when it moves in the first direction, the carriage having a first contact surface and a second contact surface that are connected to each other at a position that is nearer to the second edge portion than protruding ends of the respective stopper portions, wherein the first contact surface is inclined with respect to the main scanning directions so as to face the first edge portion, and wherein the second contact surface is inclined with respect to the main scanning directions so as to face the second edge portion.

5. The image recording apparatus according to claim 3, wherein the bias switching member is rotatable about the support shaft, wherein the rotational position of the bias switching member in the circumferential direction of the support shaft is kept within at least a predetermined range by the second guide member, wherein the bias switching member includes a switch arm protruding in a radial direction of the support shaft, wherein the second guide member includes a groove into which the switch arm extends, and wherein the groove is partially defined by a third edge portion and a fourth edge portion that extend in the main scanning directions, the third edge portion including a fifth inclined portion configured such that, when the switch arm comes into sliding contact with the fifth inclined portion, the bias switching member is rotated in a direction in which the contact portion that is in contact with the first inclined portion is caused to move toward the second inclined portion, the fourth edge portion including a sixth inclined portion configured such that, when the switch arm comes into sliding contact with the sixth inclined portion, the bias switching member is rotated in a direction in which the contact portion that is in contact with the second inclined portion is caused to move toward the first inclined portion.

* * * * *